United States Patent [19]

Dassler et al.

[11] Patent Number: 4,924,133

[45] Date of Patent: May 8, 1990

[54] HIGH-PRESSURE DISCHARGE LAMP WITH SUPPORT STRUCTURE FOR DISCHARGE VESSEL

[75] Inventors: Joachim Dassler; Klaus Kramer, both of Berlin, Fed. Rep. of Germany

[73] Assignee: Patent-Treuhand-Gesellschaft für elektrische Glühlampen mbH, Munich, Fed. Rep. of Germany

[21] Appl. No.: 265,588

[22] Filed: Nov. 1, 1988

[30] Foreign Application Priority Data

Nov. 17, 1987 [DE] Fed. Rep. of Germany ..... 3739008

[51] Int. Cl.[5] ..... H01J 61/34

[52] U.S. Cl. ..... 313/25

[58] Field of Search ..... 313/25

[56] References Cited

U.S. PATENT DOCUMENTS

| | | | |
|---|---|---|---|
| 3,621,317 | 11/1971 | Kerr | 313/25 |
| 3,882,346 | 5/1973 | McVey | 313/25 X |
| 4,229,678 | 10/1980 | Petro | 313/25 X |
| 4,254,355 | 3/1981 | Taylor | 313/25 |
| 4,709,184 | 11/1987 | Keeffe et al. . | |
| 4,755,710 | 7/1988 | Claassens et al. | 313/25 |

FOREIGN PATENT DOCUMENTS

| | | | |
|---|---|---|---|
| 0145072 | 6/1985 | European Pat. Off. . | |
| 0160445 | 6/1985 | European Pat. Off. . | |
| 2026230 | 1/1980 | United Kingdom | 313/25 |

*Primary Examiner*—Palmer C. DeMeo

*Attorney, Agent, or Firm*—Frishauf, Holtz, Goodman & Woodward

[57] ABSTRACT

To mount a discharge vessel (8) within an elongated bulb or envelope (2) while permitting thermal expansion of the discharge vessel (8) and yet maintaining the discharge vessel, free from vibration, within the tube in alignment with the longitudinal axis thereof, a flat leaf spring element (15, 15') (FIG. 2 ) is secured to a holder structure (5; 6*a*, 6*b*, 12) secured in the bulb and the respective electrode current connections (10*a*, 10*b*, 25*a*, 25*b*) to the discharge vessel, the flat leaf spring element being so located in the bulb that its major plane is oriented essentially perpendicularly to the longitudinal axis of the lamp. Preferably, the leaf spring element is an essentially flat plate, with at least one bent-over welding tab for connection to the connecting leads (6*a*, 6*b*) and cut with an essentially U-shaped punch cut to leave two outer stabilizing arms (19) and an inner part (18), which inner part is secured to the current connection from the arc tube such that the lever arm (h2) between the outer ends (20) of the two arms (19) and the longitudinal axis of the lamp is about half of the lever arm between the longitudinal axis of the lamp and the attachment of the spring element to a connecting lead (6*a*, 6*b*, 12).

14 Claims, 4 Drawing Sheets

HIGH-PRESSURE DISCHARGE LAMP WITH SUPPORT STRUCTURE FOR DISCHARGE VESSEL

Reference to related patents, the disclosures of which are hereby incorporated by reference:

U.S. 3,882,346, McVey;
U.S. 4,254,355, Taylor;
U.S. 4,709,184, Keeffe et al.
Reference to related disclosures:
European Patent Disclosure Document 0 145 072
European Patent Disclosure Document 0 160 445.

The present invention relates to high-pressure discharge lamps, such as sodium high-pressure discharge lamps, metal halide discharge lamps and the like, and more particularly to such lamps which have discharge vessels of a material which makes it desirable that the discharge vessel is so retained within an outer bulb that it can move slightly with respect thereto, for example due to differential expansion, under operating temperatures, of the discharge vessel and an outer bulb.

BACKGROUND

High-pressure discharge lamps, such as sodium high-pressure discharge lamps, usually have discharge vessels of an aluminum oxide ceramic; metal halide discharge lamps usually have discharge vessels of quartz glass. High-power lamps of these types, that is, lamps in the over 100 W power rating range, for example 150 W, 250 W, and higher, require stable holders or mounts within the bulb to securely retain the discharge vessel therein. Such holders or mounts may include a multiplicity of components or elements. The discharge vessel should be retained in a predetermined position with respect to the mount since, frequently, the discharge vessel is to be operated in conjunction with a reflector so that the position of the discharge vessel, and the light generated therein with respect to the reflector, becomes critical.

Ceramic discharge vessels have a very substantial temperature coefficient of expansion. The operating temperature of such lamps is in the order of about 1000° C. The problem arises that, due to the high operating temperature, differential expansion in operation between the discharge vessel and a metallic mount, and a glass outer bulb, has to be compensated. It is desirable to retain the axial orientation of the discharge vessel of such lamps in order to retain a predetermined position with respect to a possible reflector.

The arrangement to retain the discharge vessel in a secure and reliable position within the lamp is complicated by also providing an electrical connection to the electrodes of the discharge vessel. In the past, it was customary to separately provide for maintenance of the position of the discharge vessel in the outer bulb and for the electrical connection.

The discharge vessel, preferably, should be so retained within the bulb that it not only will retain a predetermined position, so that it can be located in a reflector, but also not be subject to excursion from the position due to vibration, while being protected against shock.

U.S. Pat. No. 4,254,355, Taylor, provides a mount of a ceramic arc tube on a support rod attached to one lead-in within an outer vitreous envelope in such a manner that expansion of the ceramic arc tube is possible. The inlet lead at one end of the arc tube is fastened to the support rod, which serves also as a conductor. At the other end, the inlet lead extends through an insulating bushing supported from the rod, and connected by a curved flexible conductor to the other lead-in located within the outer envelope. Differential thermal expansion is accomodated by sliding of the inlet lead through the bushing and, at the other end, by flexing of the conductor. The curved conductor is located in an open, approximately 180° loop of thin wire, or metal foil. The arrangement permits expansion under heating; it does not, however, dampen excursion due to vibration.

Heat expansion of the discharge or arc vessel can be accepted by an axially arranged loop of a support wire secured to a holder or mount, see U.S. Pat. No. 3,882,346. The electrical connection between the mount and the current supply is provided by an elastic metal ribbon which at the same time is intended to dampen oscillations or vibrations. The plane of the metal ribbon is, however, placed in the longitudinal axis of the lamp so that vibrations transverse to the axis of the lamp are not damped, thereby decreasing the optical characteristics of the lamp when associated with a reflector.

THE INVENTION

It is an object to improve the construction of a high-pressure discharge lamp, and more particularly of such a lamp in which an arc tube is retained within an outer bulb so that it can move slightly, but not uncontrollably under vibrating conditions, for example, which is simple, effective and reliable.

Briefly, an electrically and temperature-dependent movement-compensated joining structure for an electrical connection lead extending from a mount and an electrode connection from the arc tube or discharge tube is provided which is formed by an essentially flat leaf spring element, electrically and mechanically rigidly secured to the electrode connection from the arc tube and to the lead, the flat spring element being so located that its major plane is oriented essentially perpendicularly to the longitudinal axis of the lamp.

Preferably, the leaf spring element is a flat leaf spring plate which has an approximately U-shaped cut-out therein to define two outer legs, and an inner portion connected at the ends of the legs of the U to form a meander connection, the plate being secured by an angled-off tab to the connecting lead, for example by bump-welding, and a center portion of the plate, intermediate of the bend of the U, being connected to the electrode connection. This arrangement provides a short lever arm for deflection of the portion secured to the electrode connection, thereby minimizing any deflection of the electrode connection from an axial orientation thereof upon thermal expansion of the arc tube.

The arrangement has the advantage that the number of parts and components required for retaining the arc tube is minimized, so that the lamp can be assembled in at least semi-automatic manufacturing processes and by at least semi-automatically operating machinery. The problem of thermal expansion and electrical connection is solved at the same time and undesired oscillations are damped, with hardly any deflection of the arc tube from the longitudinal axis of the lamp, thus retaining the arc tube in essentially predetermined position with respect to its base, and hence with respect to a reflector with which a socket of the base may be associated. Drawings, illustrating exemplary embodiments:

DETAILED DESCRIPTION

Figure 1:
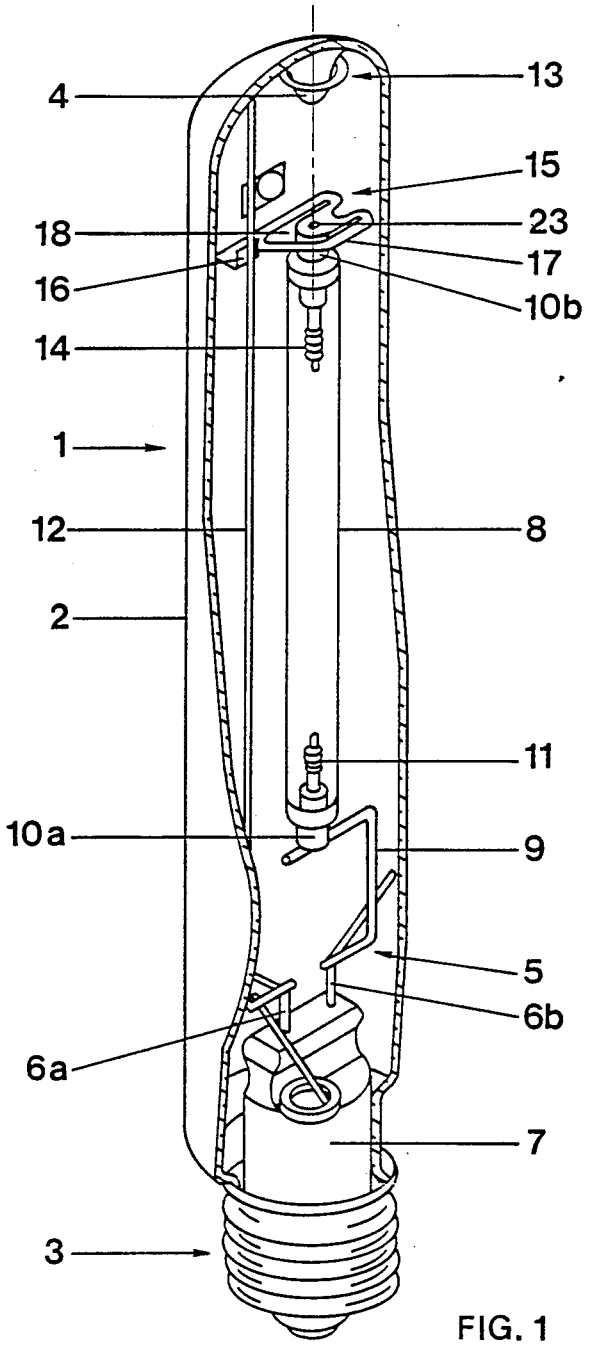
FIG. 1 is a partly broken away, part-perspective view of a sodium high-pressure discharge lamp, and the retention arrangement for the arc tube.

The basic structure will be described by selecting, as an example, a sodium high-pressure discharge lamp 1 having a nominal power rating of 150 W. The lamp 1 has an outer bulb 2 of hard glass, and a screw-in base 3, for connection in a suitable socket. The bulb 2 is essentially cylindrical, but may be elliptical in cross section; it defines a longitudinal lamp axis, and has two end portions, a base end and a remote end. The remote end of the bulb 2 is formed with an inwardly extending attachment tip or nipple 4 for a looped part 13 of a holder or mount structure 5. The holder 5 has two electrical connection leads **6*a*, 6*b* which are located, insulated from each other, in a dish mount melt connection 7, for vacuum-tight attachment with the bulb 2. They are melt-connected, as well known, and externally of the melt-connection 7, secured to base 3 in accordance with well-known lamp construction. The current supply leads 6 are formed in three sections: The section closest to the base 3 is made of nickel; in a central section, in the region of the melt connection 7, the leads 6*a*, 6*b* are made of tungsten; the end section of the lead 6 remote from the base 3 which extends outwardly of the melt connection 7 is made of nickel with an additive of about 2% of manganese, or of nickel-plated iron. The interior of the outer bulb, which may be cylindrical or elliptical, retains a discharge vessel 8** of translucent aluminum oxide ceramic, positioned in the longitudinal axis of the lamp.

One of the connecting leads **6*b* is connected to a U-shaped connection wire 9, made of nickel with 2% manganese additive, or of nickel-plated iron. The wire 9 is, in turn, connected to the lower electrode connection 10*a* formed as a niobium tube for electrode 11 within the discharge vessel 8. To ensure a reliable connection, the lead 6*b*, and extending essentially in axial direction upwardly, is angled off at 45° and is welded to the wire 9 at two engagement points. The arrangement provides for rigid maintenance of the position of the base end of the discharge vessel 8** and placement thereof within the lamp axis. A ceramic end plug is fitted, vacuum-tight, within the end portion of the discharge vessel to seal the electrode connection to the discharge vessel.

The second connection lead **6*a* is connected to a support rod 12, as well known, extending parallel to the discharge vessel 8 up to the remote end of the bulb 2. The connection lead 6*a*, likewise, is angled off at a 45° angle, and twice welded to the connection rod 12, which is formed with a right-angle end portion. The remote end of the rod 12 is angled off at right angles to the axis of the lamp and bent into a part circle 13 which is so dimensioned that it fits around the attachment tip or nipple 4, to be retained thereby. It is also possible to retain the rod 12 within the lamp without a nipple, that is, to form the outer bulb smoothly at the top; for such a connection, the diameter of the curved portion 13', forming a part circle, is so selected that it fits at the inside against the end portion of the outer bulb at the remote end thereof. The support rod 12**, preferably, is of nickel with 2% manganese added or made of nickel-plated iron.

A current connection **10*b*, for example formed as a niobium tube, connects the remote electrode 14 of the discharge vessel 8**.

In accordance with a feature of the invention, the electrode connection **10*b* is mechanically and electrically rigidly and reliably connected to the lead 6*a* via the support rod 12, the leaf spring 15 being so placed that the major plane thereof is perpendicular to the longitudinal axis of the lamp. The leaf spring 15, preferably, is a punched spring element which is directly secured to the support rod 12 of the holder 5 by bump welding an angled-off tab 16, integral with the leaf spring, to the support rod 12. The welding tab 16** is formed with, preferably, three (or two) bumps which, at the side opposite the bumps, may form tiny depressions or grooves. Bump-welding is also referred to as resistance projection seam-welding or, simply, projection-welding.

Figure 2:
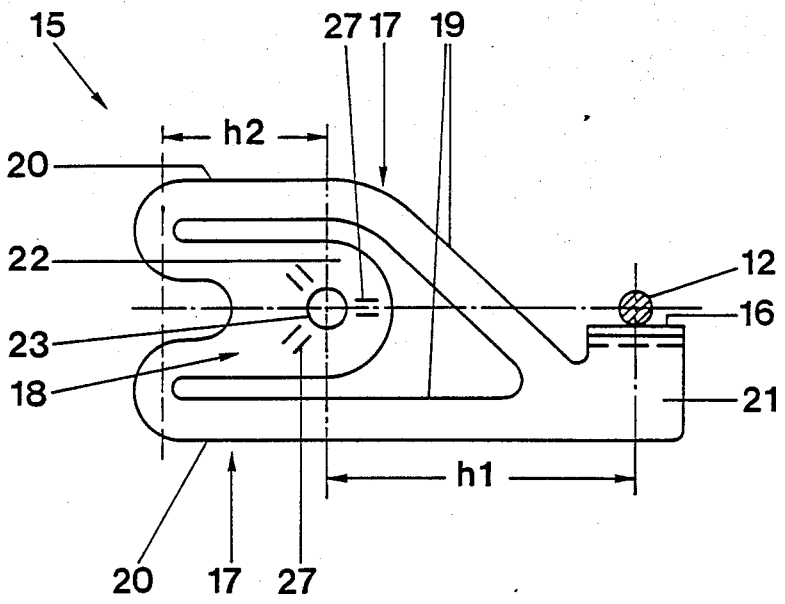
FIG. 2 is an enlarged top view of a flexible holder plate.

The punched leaf spring element 15, preferably, is a plate element which is best seen in top view in FIG. 2. In accordance with a feature of the invention, it essentially includes a stabilizing outer frame portion 17 and an interior intermediate portion 18. The outer frame portion 17 and the interior intermediate portion 18 are separated by an essentially U-shaped gap to define two outer arms 19, forming the frame portion, and which terminate in a common plate-like connecting portion 21. The arms 19 end in parallel end portions 20. The plate element 21 is integral with the bent-over tab 16 which forms the welding plate, angled off by 90° from the plate 21. The welding plate 16, for projection welding, is formed with the aforementioned bumps for connection to the support rod 12. The end portions 20 of the arms 19 are bent, in the plane of the frame , by 180° in meander shape in the direction towards the plate portion 21, that is, to form reentrant inner arms which are joined together, integrally, by a plate-like connection element 22. The plate-like connection element 22 is formed with a central opening 23. When assembled, opening 23 is located precisely in the lamp axis—see FIG. 1. It permits evacuation of the centrally welded-on niobium tube when the lamp is pumped. The attachment of the upper current supply **1O*b* of the arc tube 8 to the plate element 22 again is done by projection resistance welding. The plate element 22 is formed with three radially extending bumps or projections 27, to ensure excellent weld connection of the niobium tube with the plate element or plate portion 22**.

The entire plate 15 is a punched leaf spring element, in which all the portions thereof, except for the welding tab 16, are in a single plane. During operation of the lamp, the ceramic discharge vessel 8 will expand along the axis of the lamp in the direction towards the attachment loop 13 or 13', respectively, that is, in the direction of the remote end of the bulb. The leaf spring 15 permits such expansion without, however, permitting substantial excursion of the discharge vessel 8 from the longitudinal axis of the lamp.

The leaf spring element between the upper current supply **1O*b* and the support rod 12 could be a simple flat strip or ribbon of leaf spring, located in a plane perpendicular to the plane of the axis and only carrying the bent-over welding tab 16. In this embodiment , the distance h1 between the support rod 12, which forms a fixed point, and the current supply connection 1O*b* would be relatively long. This distance h1 is a substantially long lever arm if the discharge vessel 8 expands. This long lever arm h1, has two disadvantages with respect to the leaf spring as shown in FIG. 2. For one, the damping upon oscillation is not entirely satisfactory and, upon operation at extremely high temperatures and consequent substantial expansion of the tube 8**, a slight lateral deflection of the upper end of the discharge vessel may occur.

The leaf spring element, in accordance with a preferred feature of the invention, is shaped essentially as shown in FIG. 2, since, thereby, the lever arm is foreshortened due to the stable frame portions formed by the arms 19. Effectively, only the intermediate portion 18 between the essentially U-shaped cut-out will deflect resiliently upon thermal expansion of the arc tube 8. The lever arm, then, will be only about half as long, compare distance h2 (FIG. 2) with distance h1. The distance h2 is the distance between the 180° bend at the end portions 20 of the arms 19 and the central opening 23, which is in the lamp axis. This much shorter lever arm substantially improves the damping characteristics and lateral deflection of the discharge vessel upon heating due to expansion is minimized. In a typical example for a 150 W lamp, the lever arm h1 is about 17 mm; the lever arm h2 only about 9 mm.

The leaf spring element 15, thus, provides reliable electrical connection between the upper current supply connection **10*b* and the support rod 12 of the holder 5, via the welding tab 16 and the projections 27 in the vicinity of the opening 23**. Thermal expansion of the discharge vessel which may occur in operation, and may be in the order of about 1 mm, can be accepted and undesirable vibrations are effectively suppressed.

Figure 3:
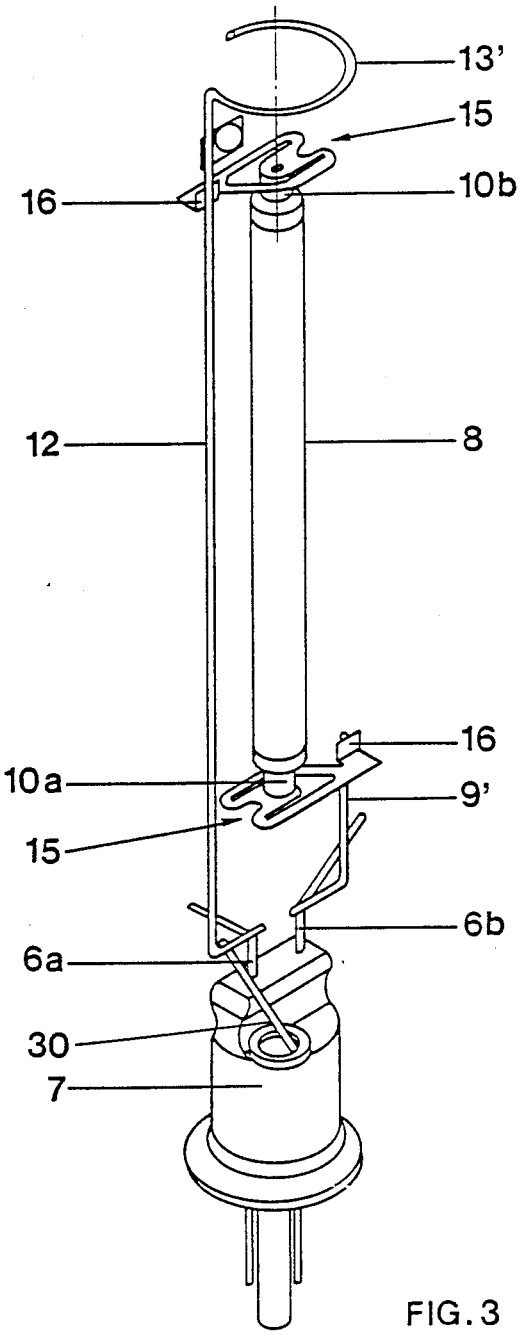
FIG. 3 is a fragmentary view of the lamp, omitting the outer bulb,and showing another holding arrangement.

The leaf spring element 15 may be located at either end of the discharge tube. A preferred position is the upper or remote end in the lamp. FIG. 3 illustrates an embodiment in which two leaf springs 15 are used, one at either end of the arc tube 8. The welding tab 16 of the lower leaf spring 15 is then securely connected to the arm 9' coupled to the connecting lead **6*b*, and which need not have an inwardly turned portion. FIG. 3 also illustrates a widened curved portion 13' which can bear against an inner wall of the bulb 2**.

Figure 4:
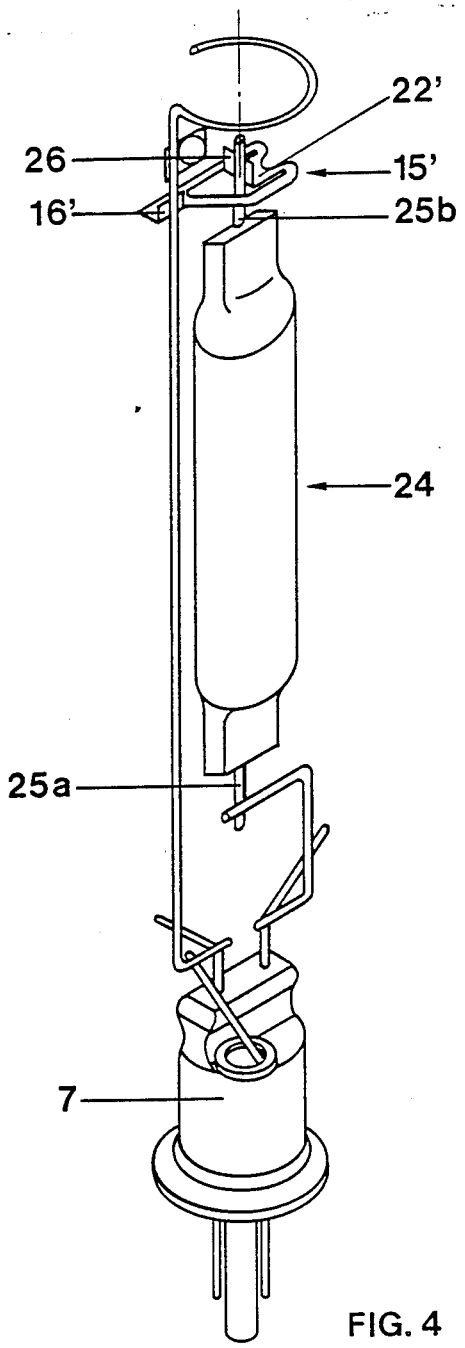
FIG. 4 is a view similar to FIG. 3 and illustrating a retention arrangement for a metal halide high-pressure discharge lamp.

The lamp construction can be used not only with sodium high-pressure lamps but, also, with other types of lamps, for example high-pressure metal halide lamps. FIG. 4 illustrates a well-known metal halide high-pressure discharge arc tube 24 which is retained within an outer bulb 2—omitted from FIG. 2 for clarity, and which can be identical to the bulb 2 of FIG. 1. The discharge vessel 24 is made of quartz glass. It has pinch or press seals at its end, in which current supply leads **25*a*, 25*b*** of molybdenum wire are sealed, for example by means of molybdenum foils. Such lamps are described, for example, in the referenced U.S. Pat. No. 4,709,184 (to which European Patent Disclosure Document EP-0S 0 173 235 corresponds) and, for example, in European Patent Disclosure Document EP-OS 0 145 072.

In accordance with a feature of the invention, at least one, and then preferably the upper or remote current supply and holding arrangement, is made in form of a leaf spring element 15' which essentially can be identical to the leaf spring element 15, with the only difference that the center portion is formed with a bent-up tab 26 for connection to the molybdenum current supply lead **25*b*. A niobium current connection, as shown in FIGS. 1–3, is usually a tube of, for example, 3.5 mm. The molybdenum wire 25*a*, 25*b* of the embodiment of FIG. 4, has a diameter which is substantially less, typically between about 0.8 to 1 mm. Consequently, the central portion 22' of the leaf spring element 15' is angled off by 90° to form the welding plate 26, to which the current supply lead 25*b* is secured. The tab 26, essentially, is similar to the tab 16', and formed with welding projections. The type of connection between the vertical support rod 12 and tab 16' is similar and can be identical to the connection of tab 26 to the current connection 25*b***.

Some sodium high-pressure discharge lamps have wire-type current connections, similar to the current connections shown in FIG. 4, and for such sodium high-pressure discharge lamps, the connection shown in the embodiment of FIG. 4 can be used—see, for example, European Patent Disclosure Document EP-OS 0 160 445.

A getter ring 30, specifically identified only in FIG. 3 for simplicity and ease of showing, is located within the space of the outer bulb 2.

Various changes and modifications may be made, and any features described may be used with any of the others, within the scope of the inventive concept.

We claim:

1. A high-pressure discharge lamp (1) having an elongated outer bulb (2) of glass, defining a longitudinal bulb axis, a base end, and a remote end, a base (3) retaining said outer bulb;

a tubular discharge vessel (8) of transparent material subject, in operation of the lamp, to temperature-dependent elongation from a nominal dimension, located within the bulb;

a pair of spaced electrodes (11, 14) and a gas fill within the discharge vessel (8);

electrode connection means (**10*a*, 10*b*, 25*a*, 25*b*) coupled to respective electrodes, and extending outwardly of the discharge vessel (8**);

a holder frame (5) for retaining the tubular discharge vessel in predetermined position in the bulb (2) including two connection leads (**6*a*, 6*b*) vacuum-tightly melted through the glass bulb (2) and connected to the base (3), one of the connection leads (6*b*) being electrically connected to one (10*a***) of the electrode connection means;

a support rod (12) secured and electrically connected to one (**6*a*) of the connection leads, said support rod extending axially towards the remote end of the bulb, and forming part of said one of the connection leads; and means (4, 13; 13') at the remote end of the bulb for locating the support rod in predetermined position in the bulb, and comprising means for providing a joining structure to the other connection lead (6*a*) of the other electrode connection means (10*b*), said joining structure being electrically conductive and temperature-dependent movement-compensated, and including an essentially flat leaf spring element (15, 15') having a major plane and being electrically and mechanically rigidly secured to the other electrode connection means (10*b*) and further electrically connected to the said connection lead (6*a***), said essentially flat leaf spring element being located in the bulb with the major plane of the flat leaf spring element being oriented essentially perpendicularly to the longitudinal axis of the bulb.

2. The lamp of claim 1, wherein said essentially flat leaf spring element (15, 15') is secured to said support rod (12) forming said one of the connecting leads and to the electrode connection means (10*b*, 25*b*).

3. The lamp of claim 1, wherein said leaf spring element (15, 15') comprises a leaf spring punched plate defining an outer frame portion (17) for stabilizing the plate, and an inner intermediate portion (18) resiliently deflectable with respect to the outer frame portion (17).

4. The lamp of claim 3, wherein said plate element comprises a connecting portion (21) and two arms (19) integral with said connecting portions, said arms and connecting portion forming the stabilizing outer frame portion.

5. The lamp of claim 4, wherein said arms (19) terminate in essentially parallel portions (20), said essentially parallel portions continuing to form reentrant portions merging with said intermediate portion (18).

6. The lamp of claim 3, further including a connecting tab portion (26) integral with the intermediate portion (18) for connecting the intermediate portion to the electrode connection means (25*b*).

7. The lamp of claim 5, wherein the intermediate portion (18) includes an attachment portion (22) formed with a central bore (23), said central bore being positioned in alignment with the longitudinal axis of the lamp.

8. The lamp of claim 4, wherein said connecting portion 21 is formed with a welding tab (16) thereon, bent 90° off the major plane of the leaf spring element, said connecting tab (16) being electrically and mechanically securely and rigidly connected to said support rod (12).

9. The lamp of claim 4, wherein the distance h2 between the ends of said arms (19) and the longitudinal axis of the lamp is about half the distance as the space h1 between the longitudinal axis of the lamp and the connecting portion (21).

10. The lamp of claim 9, wherein said connecting portion is formed with a welding tab (16) thereon, bent 90° off the major plane of the leaf spring element, said connecting tap (16) being electrically and mechanically securely and rigidly connected to said support rod (12); and wherein said distance h1 is measured between the longitudinal axis of the lamp and the connection to the support rod (12).

11. The lamp of claim 1, wherein two leaf spring elements (15, 15') are provided, one each connecting a respective connecting lead (6*a*, 6*b*) to a respective electrode connection means (10*a*, 10*b*; 25*a*, 25*b*) from said discharge vessel (8).

12. The lamp of claim 11, wherein at least one of said leaf spring elements (15, 15') comprises a leaf spring punched plate defining an outer frame portion (17) for stabilizing the plate, and an inner intermediate portion (18) resiliently deflectable with respect to the outer frame portion (17).

13. The lamp of claim 12, wherein said plate element comprises a connecting portion (21) and two arms (19) integral with said connecting portion, said arms and connecting portion forming the stabilizing outer frame portion.

14. The lamp of claim 12, wherein both said leaf spring elements comprise said leaf spring punched plate.

* * * * *